US006221121B1

(12) United States Patent
Schelter et al.

(10) Patent No.: US 6,221,121 B1
(45) Date of Patent: Apr. 24, 2001

(54) FILTER APPARATUS FOR A TEXTILE MACHINE HAVING RELIEF AND COLLECTOR ELEMENTS

(75) Inventors: Detlef Schelter, Herzogenrath; Michael Spitzer, Korschenbroich, both of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/370,269

(22) Filed: Aug. 9, 1999

(30) Foreign Application Priority Data

Aug. 10, 1998 (DE) ..... 198 36 065

(51) Int. Cl.[7] ..... B01D 29/00

(52) U.S. Cl. ..... 55/467; 55/476; 55/484; 15/352

(58) Field of Search ..... 55/467, 476, 484; 15/352, 347

(56) References Cited

U.S. PATENT DOCUMENTS

| | | | | |
|---|---|---|---|---|
| 2,140,420 | | 12/1938 | Eaddy . | |
| 4,467,494 | * | 8/1984 | Jones | 15/353 |
| 5,279,629 | * | 1/1994 | Stueble | 95/284 |
| 5,336,285 | * | 8/1994 | Grandek et al. | 55/324 |

FOREIGN PATENT DOCUMENTS

| | | | | |
|---|---|---|---|---|
| 599 995 | | 6/1978 | (CH) . | |
| 974 891 | | 5/1961 | (DE) . | |
| 1 210 723 | | 2/1966 | (DE) . | |
| 1 931 142 | | 6/1968 | (DE) . | |
| 2 028 410 | | 6/1969 | (DE) . | |
| 26 38 061 A1 | | 3/1977 | (DE) . | |
| 26 43 654 A1 | | 4/1977 | (DE) . | |
| 29 05 798 A1 | | 9/1979 | (DE) . | |
| 42 29 551 A1 | | 3/1994 | (DE) . | |
| 43 26 017 A1 | | 2/1995 | (DE) . | |
| 749 582 | | 5/1956 | (GB) . | |
| 1275036 | | 5/1972 | (GB) . | |
| 4-281811 | * | 10/1992 | (JP) | 55/467 |

OTHER PUBLICATIONS

Dedusting Systems in the Textile Industry, Author J. Unger, Journal: Textilbetrieb, May, 1983, pp. 26–29.

* cited by examiner

*Primary Examiner*—Duane Smith
*Assistant Examiner*—Robert A. Hopkins
(74) *Attorney, Agent, or Firm*—Kennedy Covington Lobdell & Hickman, L.L.P.

(57) ABSTRACT

A filter chamber (8) for the vacuum system of a textile machine (1) comprises connection conduits (14, 15) between a vacuum source (7) and a suction conduit (9) running the length of the machine. A filter 10 is arranged inside the filter chamber (8) at an interval from the wall (13) of the filter chamber to divide the filter chamber (8) into a dirty-air area (18) and a clean-air area (17).

The filter element (10) comprises at least two filter elements, a relief element (11) and a collector element (12). The relief element (11) is disposed in the filter chamber (8) at a spacing from the wall (13) of the filter chamber such that a primary component of the flow (16) of suction air from the conduit (14) to the conduit (15) for the vacuum source (7) moves parallel to or at an acute angle (I) to the relief element (11). The collector element (12) is arranged at a spacing (a) to the bottom (13') of the filter chamber and is disposed approximately orthogonally to or at an obtuse angle (J) to the primary flow component of the suction-air flow (16).

8 Claims, 4 Drawing Sheets

FILTER APPARATUS FOR A TEXTILE MACHINE HAVING RELIEF AND COLLECTOR ELEMENTS

BACKGROUND OF THE INVENTION

The present invention relates to a filter apparatus for use in cleaning a traveling airstream in association with the operation of a textile machine, especially an open-end rotor spinning machine.

Textile machines, especially textile machines operating according to the so-called open-end spinning process, usually comprise a vacuum system which is specific, i.e., dedicated, to the machine and provides the vacuum needed for the spinning process at the multiple open-end spinning stations of the machine.

As a rule, such vacuum systems comprise a vacuum source, e.g., a suction blower, a filter chamber connected upstream of the blower, and a suction conduit running the length of the machine and emptying into the filter chamber, to which conduit the individual open-end spinning units are connected via branch lines. In addition, in many of the known open-end rotor spinning machines a suction device for cleaning the soil conveyor belts of a mechanical soil removal device arranged below the spinning units is often connected to the filter chamber or to the suction conduit.

A filter element is located inside the filter chamber, usually transversely to the flow of suction air, to filter the incoming suction air which is typically contaminated with soil particles, e.g., dirt, debris, trash, foreign matter, and fibrous waste (fiber fluff, fly and remnants), etc., whereby the filter element retains the soil particles in the filter chamber.

However, these known devices have the disadvantage that the filter element becomes heavily clogged by the soil particles after a relatively short period of operation, which results in a distinct pressure drop in the vacuum system of the textile machine. Thus, since open-end spinning machines always require a minimum vacuum for proper performance of the production process, the filter elements must be cleaned at relatively short intervals of time in the known devices.

In order to lengthen these cleaning intervals, it has already been suggested that a filter element be arranged in the filter chamber in such a manner that the filter element is self-cleaning. Such a filter element is described, e.g., in German Patent Publication DE 42 29 552 A1 wherein the vacuum system of the textile machine comprises a filter chamber with two vertically standing filter elements arranged in an L-shape. A connection for a vacuum source is positioned approximately centrally in front of one of the two filter elements whereas a suction-conduit connection arranged in the cover of the filter chamber empties slightly offset to the side into the filter chamber. The flow conditions of the incoming suction airstream which are thusly developed in such an arrangement inside the filter chamber assure that at least the filter element arranged in front of the vacuum source is cleaned of adhering soil by the motion of the soil entrained in the airstream, especially fiber fluff, fly and remnants.

The known device thus requires a sufficient amount of such fibrous waste to keep the filter element clean and accordingly is primarily designed for textile bobbin winding machines in which yarn remnants always accumulate in rather large amounts as a rule. The known device is less suitable for open-end spinning machines since fibrous waste is rather low in these textile machines in relation to the relatively fine soil particles and other trash particles which are liberated during the sliver opening step in open-end spinning and must be removed.

SUMMARY OF THE INVENTION

In view of the above described state of the art, it is an object of the present invention to provide a filter apparatus with an improved filter element which will perform advantageously in a textile machine to filter fine particles of soil and trash with relatively low amounts of fibrous waste.

The invention achieves this objective by providing a novel form of filter apparatus for use in a vacuum system of a textile machine comprising a vacuum source and a suction conduit. Basically, the filter apparatus comprises a housing having a side wall and a bottom wall defining a filter chamber, a first connection device for connecting the housing to the vacuum source, a second connection device for connecting the housing to the suction conduit, and a filter disposed within the filter chamber for dividing the filter chamber into a dirty-air area and a clean-air area. According to the present invention, the filter comprises at least two filter elements including a relief element disposed in the filter chamber at a spacing from the side wall and relative to the first and second connection devices such that a flow of suction air therebetween travels between essentially parallel to and essentially an acute angle to the relief element, and a collector element disposed in the filter chamber at a spacing from the bottom wall and relative to the first and second connection devices such that a flow of suction air therebetween travels between essentially orthogonally to and essentially an obtuse angle to the collector element.

The design of the filter of the present invention and the special arrangement of the filter elements inside the filter chamber assure that the soil particles, which pass via the suction-conduit connection into the filter chamber and are for the most part quite fine, are deposited immediately on the collector element and remain thereon. That is, the relief element, along which the suction airstream initially flows almost parallel thereto, remains very largely free of soil particles. The orientation of the air flow to be almost tangential in the area of the relief element even causes soil particles which may adhere at first to the relief element too be separated from the relief element by the air flow, transported in the direction of the collector element and deposited thereon. Thus, this arrangement of the filter elements in accordance with the present invention has the effect of assuring flow conditions prevail in the area of the relief element over a long period of time under which conditions a flow component which is essentially tangential, i.e., parallel or at least substantially acute, relative to the relief element is distinctly greater than any flow component directed more orthogonally toward the filter element. The apparatus of the invention has distinct advantages compared to conventional filter apparatus both with respect to the degree of the pressure loss as well as with respect to the time at which the pressure drop begins.

The first connection device via which the filter housing is connected to a vacuum source, e.g., a suction blower, is preferably disposed in the bottom area of the filter housing. For example, the connection device may be fitted in the side wall of the filter housing, preferably at or just above the bottom wall of the housing. In this embodiment, the collector element is positioned at least partially above the first connection device for the vacuum source, preferably in approximately horizontal alignment and at a relatively distinct spacing from the bottom wall of the filter housing. In another embodiment, the first connection device may be integrated directly into the bottom wall of the filter housing.

In both embodiments, a certain pressure difference develops in the area above the bottom of the filter housing, i.e., in the clean-air area below the collector element, in comparison to the dirty-air area above the collector element. The impulse forces which prevail as a result assure that the fine soil particles located in the area of dirty air are reliably held fast on the collector element.

Preferably, the second connection device to the suction conduit is disposed in the upper area of the filter housing and fitted in the top wall, i.e., the cover, of the filter housing to be opposite and in facing relation to the collector element. The previously described arrangement for the first vacuum-source connection device in conjunction with this selected positioning of the second suction-conduit connection device in the upper area of the filter chamber results in a flow of suction air having a relatively strong primary flow component moving parallel or at an acute angle to the relief element which thereby reliably cleans the relief element. Since this tangential flow component prevents the fine soil particles supplied via the suction conduit from being able to settle on the relief element, a sufficiently large flowthrough of air is assured in the area of the filter for a long period of time and the vacuum necessary for a frictionless spinning operation is thereby assured in the air system specific to the textile machine.

Instead of two filter elements preferably arranged in an L-shape, other arrangements are also conceivable in which, e.g., several filter elements form a filter which divides the filter chamber into a dirty-air area and a clean-air area.

Several filter elements at a spacing from the side walls of the filter chamber can be connected, for example, at an angle to a relief element which is sealed dust-tight in the direction of the first connection device to the vacuum source by a collector element.

In another alternative embodiment, the filter element may comprise a cylindrical relief element and a collector element which seals the relief element in the direction of the first connection device to the vacuum-source.

As a further embodiment of the invention, it is contemplated that, instead of a single horizontally arranged collector element, several collector-element segments abutting each other, e.g., at an obtuse angle, may be used.

Further features, details and advantages of the present invention will be understood from exemplary embodiments described in the following specification with reference to the accompanying drawings.

DETAILED DESCRIPTION OF THE PREFERRED EMBODIMENTS

Figure 1:
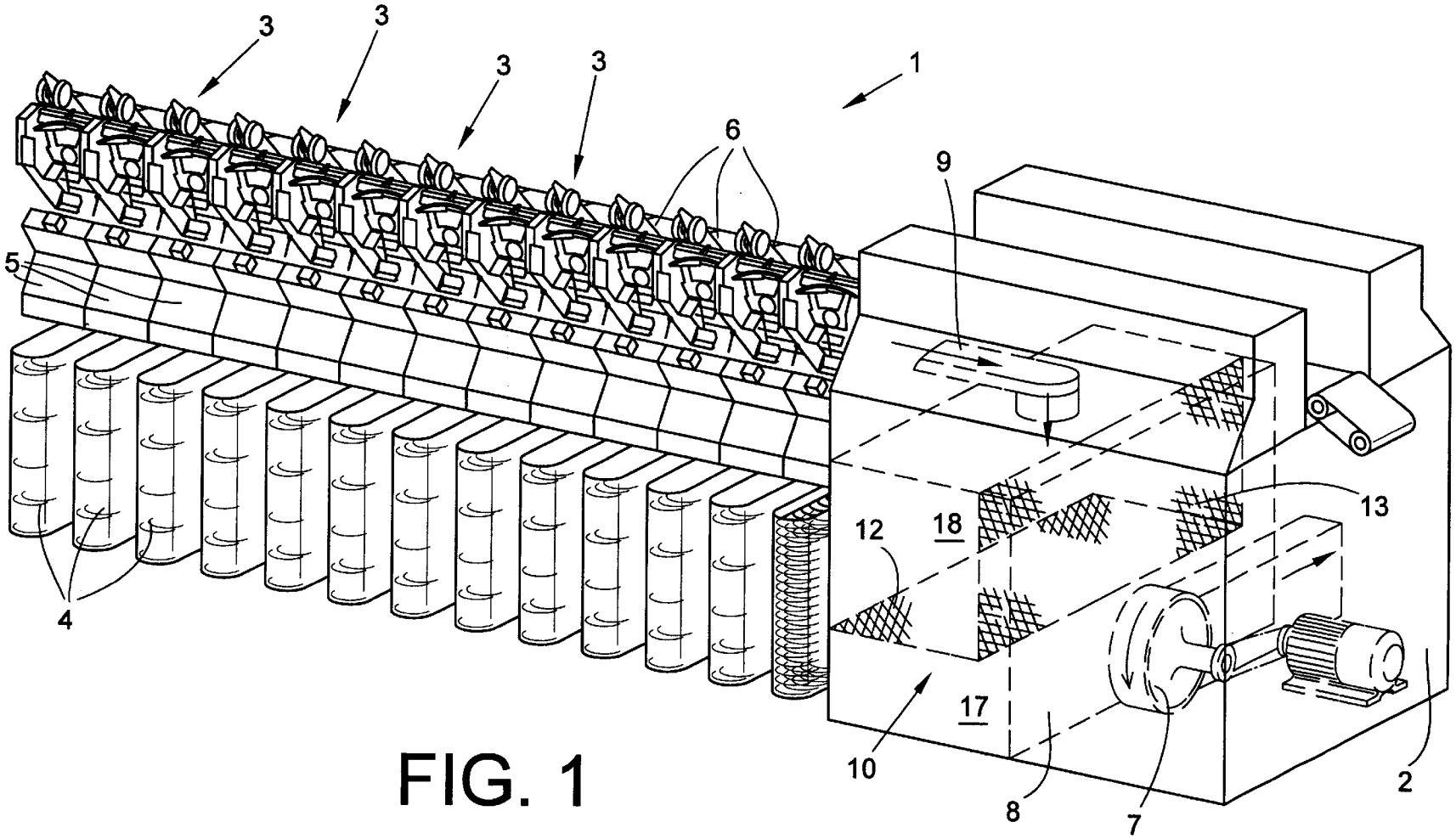
FIG. 1 is a perspective view of an open-end spinning machine taken from the area of one end frame thereof which is equipped with a filter box in accordance with the present invention.

Referring now to the accompanying drawings and initially to FIG. 1, one end area of an open-end rotor spinning machine is shown and designated in its entirety at 1.

Such textile machines comprise as a rule two opposite end frames 2 and a plurality of open-end spinning stations 3 arranged in alignment with one another between the end frames. Sliver supplied from sliver storage cans 4 is spun at each of the spinning locations 3 by respective open-end spinning units 5 into yams which are subsequently wound on winding devices 6 specific to the spinning locations to form large-volume cross-wound bobbins (not shown).

Open-end spinning units 5 require vacuum for the spinning process. This vacuum is made available by a vacuum system specifically dedicated to the machine and basically comprising vacuum source 7, filter housing 8 which defines an interior filter chamber, and suction conduit 9 extending the full length of the machine (only a partial extent of the overall length of the conduit being depicted). The rotor housings of open-end spinning units 5 are connected to suction conduit 9 in the area of spinning stations 3 via pneumatic branch lines in a manner which is known and therefore not shown in more detail.

The suction lines of a soil removal system specific to the machine are also typically connected in the area of end frame 2 to suction conduit 9 or directly to filter housing 8. This soil removal system usually consists of soil conveyor belts which run the length of the machine at a disposition below the sliver opening devices of open-end spinning units 5 and from which belts the soil is pneumatically removed in the area of end frame 2 by a suction device which is known and therefore not shown.

As indicated, filter housing 8 of the vacuum system of textile machine 1 defines an interior filter chamber in which is disposed filter 10. According to the present invention, filter 10 consists of at least two filter elements. One filter element is formed by relief element 11 whereas the other filter element functions as collector element 12.

Figure 2:
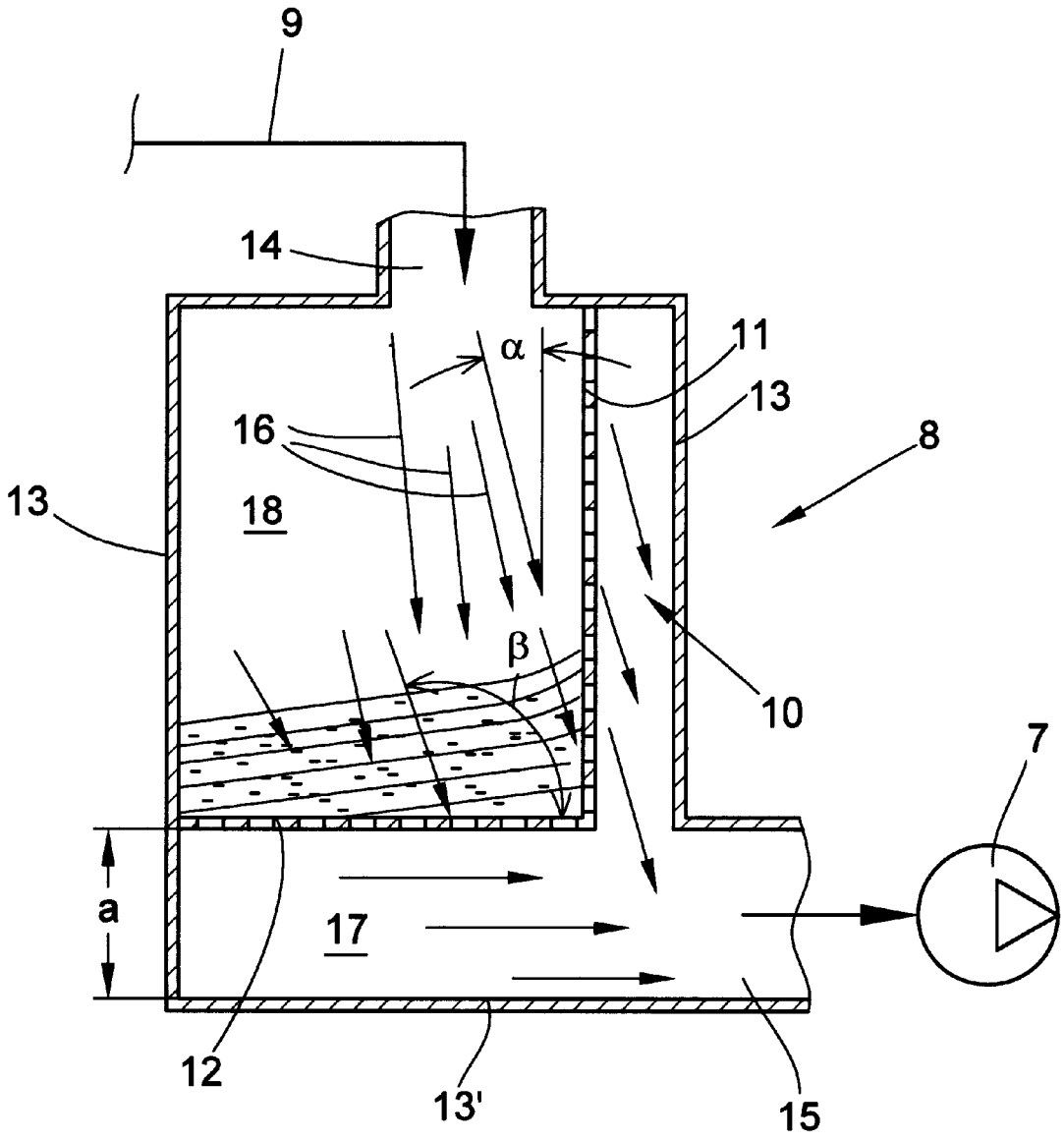
FIG. 2 is a vertical cross-sectional view of the filter box according to FIG. 1.

As is apparent from FIG. 2 in particular, relief element 11 and collector element 12 are connected in an L-shaped arrangement with relief element 11 disposed vertically adjacent the suction-conduit connection device 14 at a spacing from side wall 13 of filter housing 8 and collector element 12 disposed horizontally above connection device 15 for vacuum source 7. In this manner, relief element 11 is arranged such that the flow of incoming airstream 16 from connection device 14 to the suction conduit 9 moves through the filter chamber to connection device 15 for the vacuum source 7 in an orientation which is primarily between parallel and an acute angle with respect to relief element 11 and between approximately orthogonally and an obtuse angle with respect to collector element 12.

More specifically, collector element 12 is preferably positioned at an spacing a above bottom wall 13' of the filter housing 8, which interval a is selected to be sufficiently large that the air pressure which develops in clean-air area 17 below collector element 12 is relatively lower than the air pressure of dirty-air area 18 above collector element 12. In this manner, soil particles 19 which pass with airstream 16 into dirty-air area 18 of filter housing 8 settle, as shown, on collector element 12 whereas relief element 11 remains to a great extent free of these soil particles.

Figure 4:
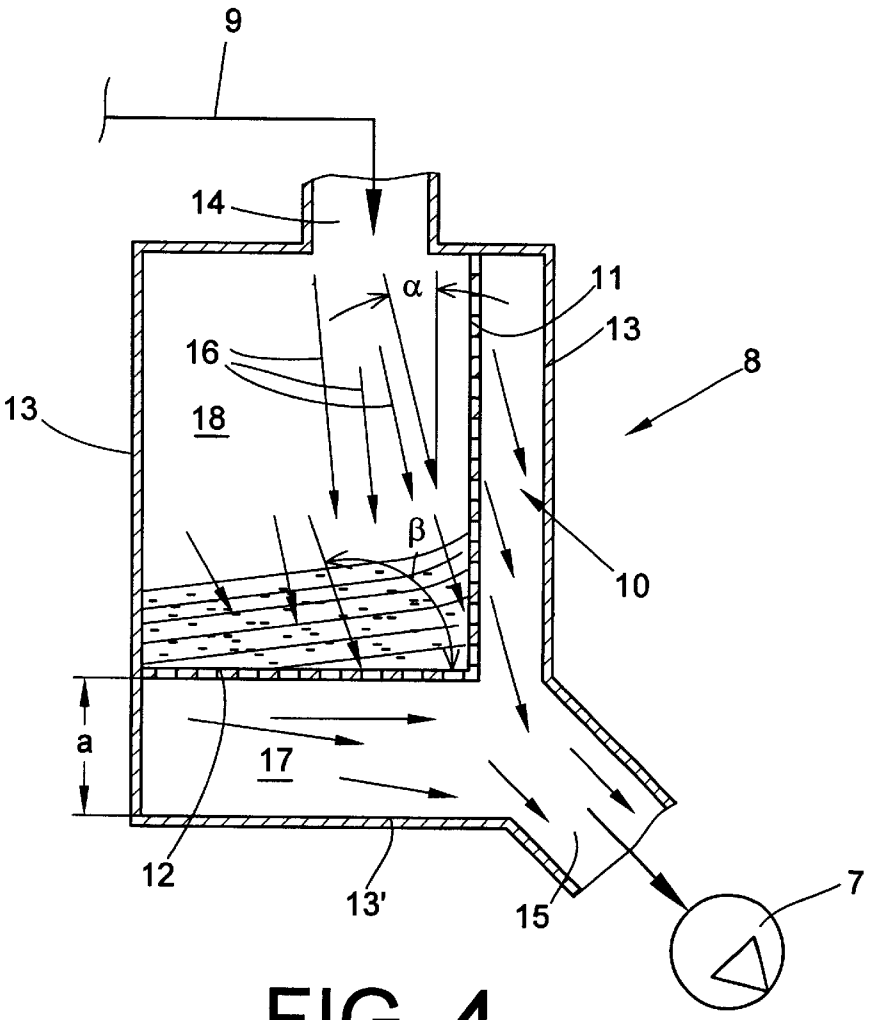
FIG. 4 is another vertical cross-sectional view, similar to FIGS. 2 and 3, depicting a third embodiment of a filter box shown in accordance with the present invention.
Figure 3:
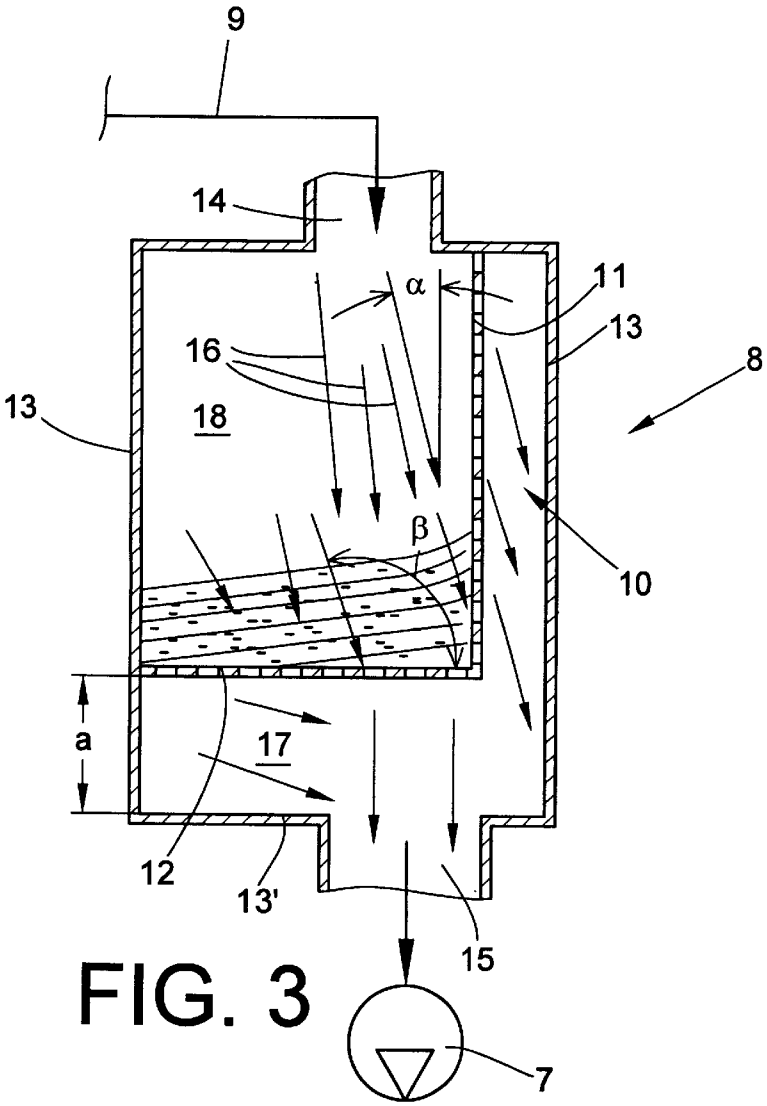
FIG. 3 is another vertical cross-sectional view, similar to FIG. 2, depicting another embodiment of a filter box shown in accordance with the present invention.

FIGS. 3 and 4 show other exemplary embodiments for the arrangement of vacuum-source connection device 15 in the filter housing 8. According to the exemplary embodiment of FIG. 3, connection device 15 for vacuum source 7 is arranged directly in bottom wall 13' of the filter housing 8, preferably in essentially opposed facing relation to suction-conduit connection device 14.

FIG. 4 shows an embodiment in which connection device 15 is arranged at the area of the lower comer between the side wall 13 and the bottom wall 13' of the filter housing 8.

Figure 6:
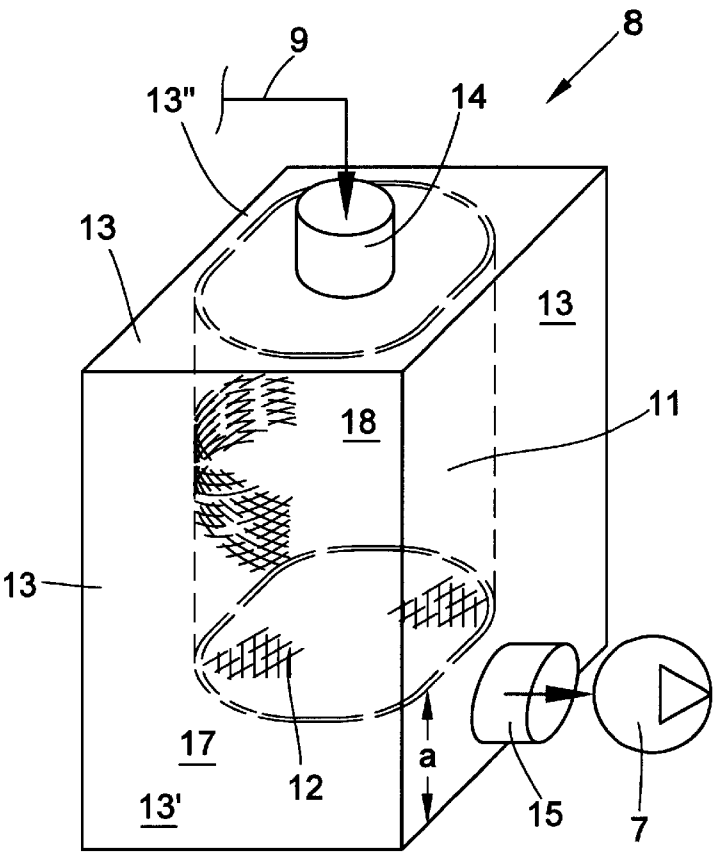
FIG. 6 is a perspective view depicting a fifth embodiment of a filter box in accordance with the present invention.
Figure 5:
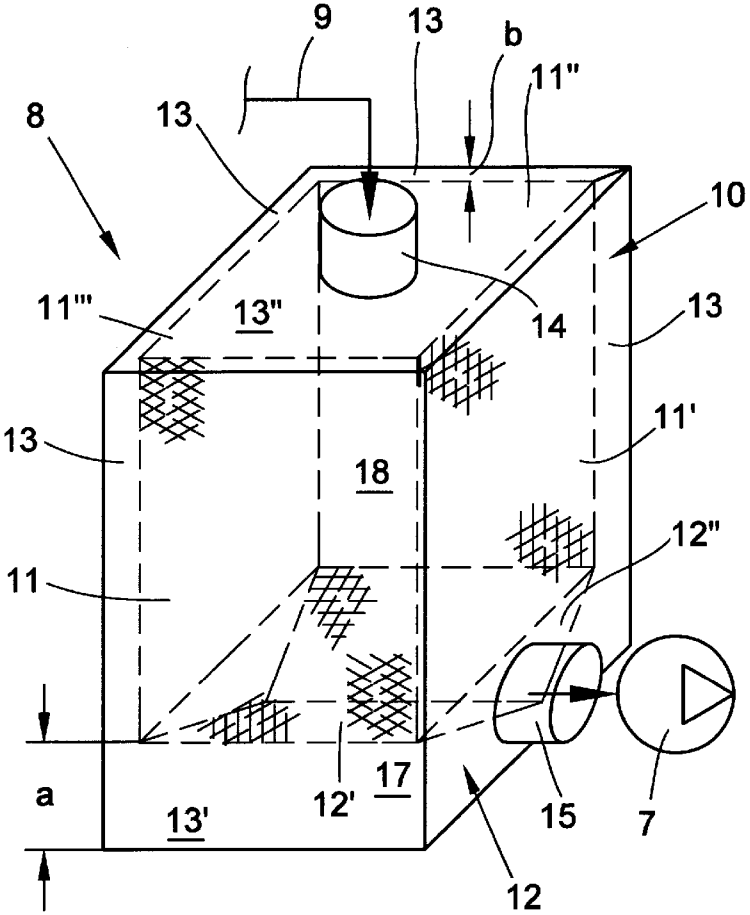
FIG. 5 is a perspective view depicting a fourth embodiment of a filter box in accordance with the present invention.

FIGS. 5 and 6 show other embodiments of filter 10 from that of the previous figures. According to the embodiment of FIG. 5, filter 10 comprises several, e.g., four filter elements 11, 11', 11" and 11'", disposed at an angle to each other and each arranged at a spacing from the respective side walls 13 of filter housing 8 to collectively form a continuous annular relief element, with a collector element 12 connected between the lower edges of the relief elements. The continuous relief element surrounds the suction-conduit connection device 14 and, with the collector element 12, encloses the dirty-air area 18 of filter housing 8. Here again, collector element 12 preferably is disposed at spacing a to bottom wall 13' of filter housing 8 and thereby is disposed at least partially above connection device 15 for vacuum source 7.

Collector element 12 can also consist of individual segments 12', 12", as indicated in FIG. 5, which abut each other edgewise, e.g., at an acute angle. Suction conduit 9 empties into dirty-air area 18, as described above with respect to the previous Figures. The corresponding connection device 14 is arranged in top cover wall 13" of filter housing 8.

FIG. 6 shows another, alternative embodiment of filter 10. Filter 10 in this embodiment has cylindrical relief element 11 which, as in the previously described embodiments, is disposed at a minimum spacing from side walls 13 of filter housing 8. Cylindrical relief element 11 is sealed dust-tight at its bottom edge by collector element 12, which may be, e.g., a flat filter element as shown or, alternatively, may consist of a convex or conical collector element or several filter segments 12', 12", etc. In each case, collector element 12 is disposed at a spacing a from bottom wall 13' of filter housing 8.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A filter apparatus for use in a vacuum system of a textile machine comprising a vacuum source and a suction conduit, the filter apparatus comprising a housing having a side wall and a bottom wall defining a filter chamber, a first connection device for connecting the housing to the vacuum source, a second connection device for connecting the housing to the suction conduit, and a filter disposed within the filter chamber for dividing the filter chamber into a dirty-air area and a clean-air area, the filter comprising at least two filter elements including a relief element disposed in the filter chamber at a spacing from the side wall and relative to the first and second connection devices such that a flow of suction air therebetween travels between essentially parallel to and essentially an acute angle to the relief element and a collector element disposed in the filter chamber at a spacing from the bottom wall and essentially between the first and second connection devices such that a flow of suction air therebetween travels between essentially orthogonally to and essentially an obtuse angle to the collector element.

2. The filter apparatus according to claim 1, wherein the first connection device is connected with the housing in the area of the bottom wall and the collector element is arranged approximately horizontally at a spacing from the first connection device.

3. The filter apparatus according to claim 1, characterized in that the first connection device is connected with the bottom wall of the housing.

4. The filter apparatus according to claim 1, characterized in that the second connection device is disposed vertically above the first connection device.

5. The filter apparatus according to claim 4, characterized in that the housing comprises a top cover wall and the second connection device is connected with the top cover wall.

6. The filter apparatus according claim 1, characterized in that the filter comprises a plurality of the relief elements each disposed at a spacing from the side wall of the housing.

7. The filter apparatus according claim 1, characterized in that the filter comprises a cylindrical relief element.

8. The filter apparatus according to claim 1, characterized in that the collector element comprises a plurality of collector segments.

* * * * *